US006698626B2

(12) United States Patent
McKay

(10) Patent No.: US 6,698,626 B2
(45) Date of Patent: Mar. 2, 2004

(54) LINT REMOVER AND SPRAY DISPENSER APPARATUS

(76) Inventor: William D. McKay, G-9082 S. Saginaw St., Grand Blanc, MI (US) 48439

( * ) Notice: Subject to any disclaimer, the term of this patent is extended or adjusted under 35 U.S.C. 154(b) by 0 days.

(21) Appl. No.: 10/143,396

(22) Filed: May 10, 2002

(65) Prior Publication Data

US 2003/0209564 A1 Nov. 13, 2003

(51) Int. Cl.[7] ..... B67D 1/07

(52) U.S. Cl. ..... 222/192; 15/104.002; 15/104.94; 15/105

(58) Field of Search ..... 222/192; 15/104.002, 15/104.94, 105, 118

(56) References Cited

U.S. PATENT DOCUMENTS

| | | | | | |
|---|---|---|---|---|---|
| 3,011,499 | A | * | 12/1961 | Tajan | 401/139 |
| 3,056,154 | A | | 10/1962 | Neal | 15/104 |
| 3,102,544 | A | * | 9/1963 | Keegan et al. | 132/147 |
| 3,158,887 | A | | 12/1964 | Kanbar et al. | 15/104 |
| 3,299,461 | A | | 1/1967 | Marks | 15/104 |
| 3,373,457 | A | | 3/1968 | Rouch, Jr. | 15/104 |
| 3,665,543 | A | | 5/1972 | Nappi | 15/215 |
| 4,062,083 | A | | 12/1977 | McKay | 15/106 |
| 4,107,811 | A | | 8/1978 | Imsande | 15/215 |
| 4,244,587 | A | * | 1/1981 | Schweizer | 15/104.8 |
| 4,361,923 | A | | 12/1982 | McKay | 15/104 |
| 4,399,579 | A | | 8/1983 | McKay | 15/104 |
| 4,422,201 | A | | 12/1983 | McKay | 15/104 |
| 4,727,616 | A | | 3/1988 | Kucera et al. | 15/104 |
| 4,742,547 | A | | 5/1988 | Watanabe | 15/104 |
| 4,850,073 | A | * | 7/1989 | Preuss | 15/207.2 |
| 4,905,337 | A | | 3/1990 | McKay | 15/104 |
| 5,027,465 | A | | 7/1991 | McKay | 15/104 |
| D320,680 | S | | 10/1991 | Stetson et al. | D30/158 |
| D342,610 | S | | 12/1993 | Stetson et al. | D4/122 |
| D363,214 | S | | 10/1995 | Parola et al. | D9/300 |
| 5,819,989 | A | | 10/1998 | Saraceni | 221/192 |
| 5,878,457 | A | | 3/1999 | Cox et al. | 15/104.002 |
| 6,014,788 | A | | 1/2000 | Jaffri | 15/104.002 |
| 6,055,695 | A | | 5/2000 | McKay, Jr. | 15/104.002 |
| 6,127,014 | A | | 10/2000 | McKay, Jr. | 428/43 |
| 6,298,517 | B1 | | 10/2001 | McKay | 15/228 |
| 6,325,070 | B1 | * | 12/2001 | Tyroler et al. | 132/112 |

* cited by examiner

*Primary Examiner*—Kevin Shaver
*Assistant Examiner*—S L Willatt
(74) *Attorney, Agent, or Firm*—Young & Basile, PC

(57) ABSTRACT

A lint remover and spray dispenser apparatus rotatably supports a tubular adhesive lint remover tape roll or fixedly supports a single strip or multiple strips of a directional lint remover fabric. The apparatus includes an elongated handle section and a cylindrical or oblong support section. The elongated handle has an open end having external threads adjacent to the open end. A spray top having a hand pump and a threaded cap is mounted on the elongated handle. The liquid container-handle combination may be a molded polymer container having a trigger activated spray pump attached thereto. Alternately, the handle is configured to receive a separate liquid spray dispenser container.

20 Claims, 4 Drawing Sheets

LINT REMOVER AND SPRAY DISPENSER APPARATUS

BACKGROUND

The present invention relates to a lint remover including either a revolving tape roll with outwardly facing adhesive or adhesively attached directional lint brush material.

There are many previously known lint roller assemblies. These previously known lint roller assemblies typically include a handle secured to a cylindrical lint roller support. A tubular lint roll is then removably mounted to the support such that the adhesive roller is rotatable relative to the handle. In use, the adhesive lint roller is rolled along a user's clothing, upholstery, or carpet to remove lint, fuzz, pet hair, and other debris.

The previously known lint rollers have used a number of different means to rotatably mount the lint roller support to the handle. For example, in U.S. Pat. No. 4,361,923, the lint roller support/handle are separately constructed and then secured together. A disadvantage of this type of lint roller assembly, however, is that the rotatable connection between the handle and lint roller support is subjected to mechanical wear and tear and ultimately mechanical failure. Another disadvantage is that the two pieces require assembly. A still further disadvantage of this type of previously known lint roller assembly is that the lint roller support assembly rotates making it impossible to lock in place for use with directional lint remover fabric, which requires a fixed support section to facilitate a brushing motion. Still other types of previously known lint remover assemblies, such as that disclosed in U.S. Pat. No. 6,055,695, have the handle injection molded in two halves which, however, requires expensive and complex molds and assembly, which is slow and expensive.

A still further disadvantage of these types of previously known lint roller assemblies is that they serve a single use; i.e., to pick up lint, hair, and other particles using revolving tape or adhesive coated rolls and do not provide other cleaning means, such as a liquid fabric refresher, fabric relaxers, colognes/perfumes, deodorizers, no-rinse pet and fabric cleaners and, therefore, do not facilitate a complete 2-in-1 cleaning system.

SUMMARY

The present invention is a lint remover and spray dispenser apparatus that overcomes most of the above mentioned disadvantages of the previously known lint remover devices.

Specifically, the lint removal and liquid spray apparatus includes a container, a liquid storage chamber coupled to the container, a lint removal means, means carried on the container for receiving the lint removal means on the container, and dispenser means disposed in fluid communication with the liquid storage chamber for dispensing fluid from the chamber.

The lint removal means includes one or both of a roll or outwardly facing adhesive tape and at least one directional fabric strip.

The receiving means rotatably supports the roll of adhesive tape on the container. An intermediate portion of the container fixedly receives the at least one directional fabric strip. In one aspect, the directional fabric strip is mounted on a support section of the container and is spaced from an outer concentrically mounted roll of adhesive tape, rotatably supported on the support section of the container.

In another aspect, the liquid storage chamber is formed as an internal chamber integral the internal chamber within the container. In this aspect, the dispenser means is mounted on the container.

In another aspect, the liquid storage chamber is disposed in a separate body which is releasably mounted in the container. In this aspect, the dispenser means is carried on the separate body.

The combined lint remover and spray dispenser apparatus overcomes many of the problems associated with the previously devised lint removal devices by providing an easily usable, simple to manufacture, low cost apparatus which is capable of receiving either a roll of adhesive tape or a directional fabric for lint removal purposes. At the same time, the present apparatus uniquely is configured to contain a liquid for selective dispensing onto a surface to be cleaned.

The present apparatus therefore provides a complete cleaning means for surfaces which previously would have required two separate devices, namely a lint remover and a separate cleaning liquid spray container.

BRIEF DESCRIPTION OF THE DRAWING

These and other objects of the present invention will become readily apparent upon further review of the following specification and drawing in which.

DETAILED DESCRIPTION

Figure 1:
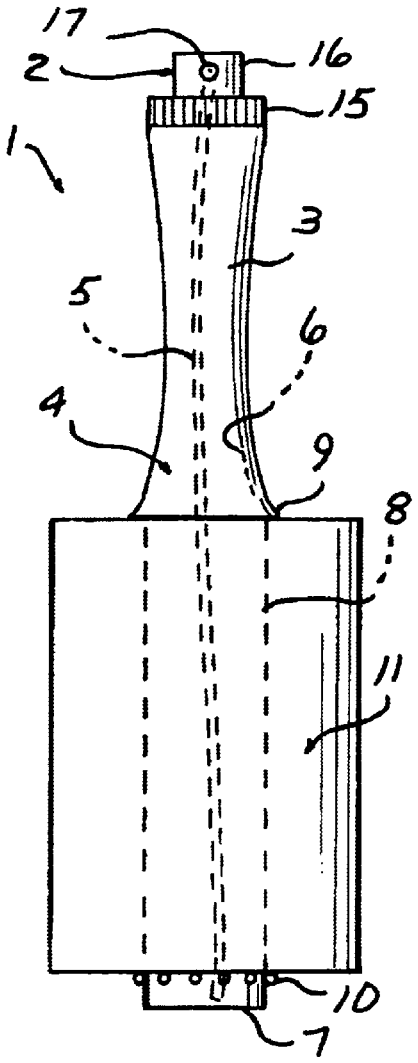
FIG. 1 is a side elevational view of a combination lint remover tape roll and spray dispenser apparatus according to a first embodiment of the present invention with the revolving lint tape roll in place.

With reference first to FIG. 1, one aspect of the combined lint remover and spray dispenser apparatus 1 is shown as including a liquid dispensing means, such as a spray pump cap 2', which threadingly engages one end of an elongated handle section 3 of a liquid storage container 4. A liquid transferring tube 5 running substantially through the interior of a hollow chamber 6 within the container 4 which receives and stores a liquid solution. The container 1 is formed of a base portion 7 and an integral, elongated neck portion forming the handle section 3, which together define the hollow chamber 6. A support section 8 has a top bead or rim portion 9 and outwardly extending protrusions 10, which lock a tape roll 11 in place. The tape roll 11 may be formed by conventional methods of an elongated single piece of outwardly facing adhesive or, more typically, a plurality of end to end arranged, separatable strips wound in a roll about a hollow center. Each sheet is separable from the tape roll 11 when soiled or dirty to expose an underlying clean adhesive strip. An example of a lint remover tape roll can be found in U.S. Pat. No. 4,361,923.

The handle portion 3 may have a generally constant diameter, cylindrical shape or, more preferably, a smoothly curved concave shape for easy grasping by the user for use of the lint remover roll 11 or the dispenser 2.

The support section 8 about which the tape roll 11 is mounted, may have a reduced diameter from the major diameter of the handle 3. Alternately, the support section 8 may have the same diameter as the handle 3. The rim portion 9 flares radially outward from the support section 8 to form a shoulder for supporting one end of the tape roll 11 as shown in FIG. 1. The tape roll 11, which has a hollow bore extending therethrough, is urged from one end over the projections 11 and about the support section 8 on the container 1 until the opposite end of the tape roll 11 seats against the shoulder 9. At this time, the trailing end of the tape roll 11 is located inside of the projections 10 so that the tape roll 11 is rotatably mounted on the support section 8.

The hollow container 1 is formed preferably of one piece utilizing a blow molding process and materials such as polyethylene, PET, polyvinyl chloride, or similar thermoplastic material. The lint tape roll support section 8, framed by upper and lower outwardly protrusions 9 and 10, has a diameter less than the inside diameter of the adhesive tape lint roll 11. Alternately, the container 1 can be formed of two halves joined together to form a sealed member.

In order to mount the pump spray type liquid dispenser 2 to the container 1, the pump sprayer 2 has a cap 15 for threaded engagement with the top of the elongated handle section to securably seal to the container 1. Alternately, the cap 15 may be configured for a snap-on engagement with a projection on an end portion of the handle 3. The pump sprayer type dispenser 2 includes a hose extending from the pump sprayer 2 into the container 1 for carrying the liquid contents to the spray or trigger nozzle 17.

Alternately, the pump spray type liquid dispenser cap 15 and nozzle 17 can be replaced by a known trigger handle operated pump dispenser.

Figure 2:
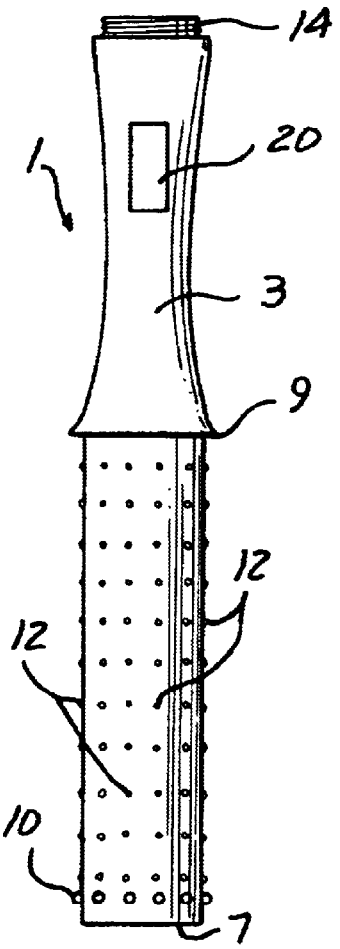
FIG. 2 is a side elevational view of the combination lint remover and spray dispenser apparatus of FIG. 1 without the tape lint roll and without a pump dispensing sprayer.

As shown in FIG. 2, exterior threads 14 are formed on one end of the container 1 for receiving the threaded cap 15 carrying a push type spray head 16 with a dispenser nozzle 17 carried therein. The tube 5 is connected at one end to the dispenser nozzle 17 and extends through the container 1 preferably into close proximity with the base 7. A spring, not shown, may be mounted within the head 16 for returning the head 16 to the outward disposed position shown in FIG. 1 after each spray dispensing depression.

In order to rotatably mount and secure the tubular cylindrical adhesive tape lint roll 11 to the lint support section 8, a plurality of circumferentially spaced, radially outwardly facing protrusions 10, such as flexible fingers, beads, solid or broken bands, are formed at the end or bottom of the support section 8 opposite or perpendicular to the handle 3. These flexible fingers, beads, or bands 10 have an outside diameter greater than the inside diameter of the lint roller 11 such that with the lint roller 11 inserted over the lint roller support 8, the flexible fingers, beads, solid or broken bands 10, extend outwardly along the bottom end of the support section 8 entrapping the lint tape roll 11 within the top and bottom ends of the support section 8. The protrusions, fingers, beads, partial or solid bands 10 can be substantially flexible so as to flex to permit the installation and removal of the tape roll 11 onto the roller support 8.

In order to minimize the frictional contact between the support section 8 and the adhesive lint tape roll 11, a plurality of outwardly facing ribs or nibs 12 are optionally formed along the outer periphery of the support section 8. By minimizing the contact area between the inner wall of the tape roll 11 and the support section 8 utilizing the ribs or nibs 12, only minimal frictional contact occurs between the interior of the lint tape roll 11 and outer periphery of the lint roller support section 8, thereby encouraging free rotation of the lint roller 11 about the support 8. These raised ribs or nibs 12 may also strengthen the lint roller support section 8.

The lint remover 1 is operated with one hand while the tape roll 11 resolves to pick up lint, fuzz, pet hair, etc. from surfaces and to provide for dispensing liquid solutions as needed to completely treat the surface.

A panel or logo area 20 can optionally be formed on the exterior of the handle section 3 for receiving a decoration, logo or product advertisement.

Figure 3:
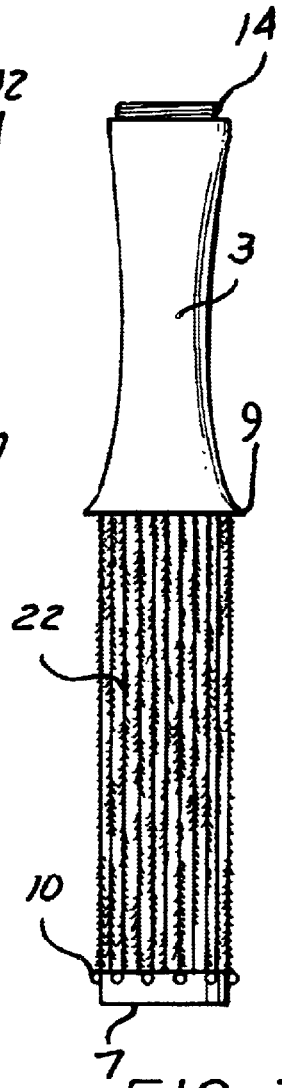
FIG. 3 is a side elevational view of another aspect of the combination lint remover and spray dispenser apparatus of the present invention with directional lint removal fabric attached to one or more sides.
Figure 4:
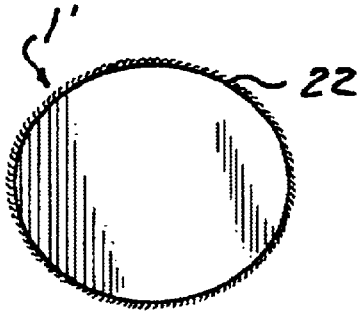
FIG. 4 is a bottom view of the combination lint remover and spray dispenser apparatus shown in FIG. 4 with the directional lint removal fabric attached 360 degrees around the support section.
Figure 5:
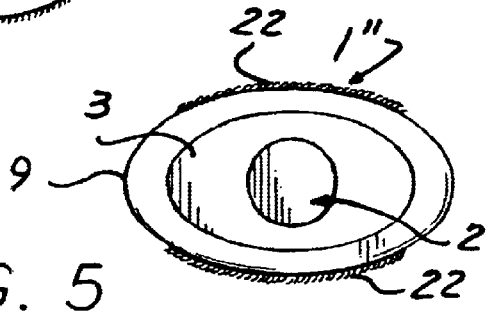
FIG. 5 is a top view of the combination lint removal and a spray dispenser with an oblong handle and oblong support section with directional lint removal fabric attached partially around the support section.

FIGS. 3, 4 and 5 depict alternate aspects of the present apparatus. In FIG. 3, the container 1 is formed essentially the same as the container 1 shown in FIGS. 1 and 2 and described above. However, in this aspect of the invention, a lint remover means is in the form of a sheet of directional lint removing fabric 22. The fabric sheet 22 may be permanently or releasably mounted about the support section 8 by a suitable adhesive. Other mounting means, including fasteners, Velcro, sonic or mechanical bonding, etc., may also be employed. It should also be noted that in this aspect of the present invention, the shoulder 9 and projections 10 may not be required.

The fabric 22 is a dimensional woven nylon pile velvet created by cutting intertwined yard threads. The pile surface is heat set in a specific direction to guarantee directional uniformity. This enables the sheet 22 to be drawn in one direction across a surface to be cleaned to pick up lint and other debris from the surface. Dragging the sheet 22 in an opposite direction about another surface removes any collected lint and debris from the sheet 22.

FIG. 4 depicts a bottom view of another aspect of a container 1'. In this aspect, the container 1" has a generally oval shape with the directional lint remover fabric 22 disposed substantially completely 360 degrees about the exterior of the container 22.

In FIG. 5, a container 1" has a more elongated, oblong shape.

Figure 6:
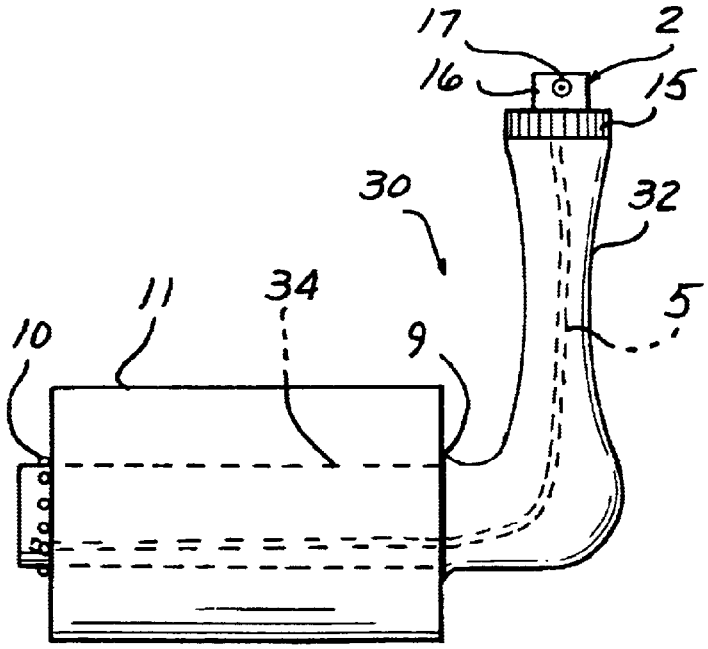
FIG. 6 is a side elevational view showing an alternate aspect of the combination lint remover and spray dispenser apparatus according to the present invention.

Referring now to FIG. 6, there is depicted another aspect of a combined lint remover and spray liquid dispenser 30 which includes essentially the same elements as the container 1, but has the elements disposed in a different external configuration or shape. Thus, the container 30 includes a handle 32 and a lint roll support 34. In this aspect, however, the handle 32 is disposed at an angle, typically substantially ninety degrees or perpendicular, to the axial extent of the support 34.

Figure 7:
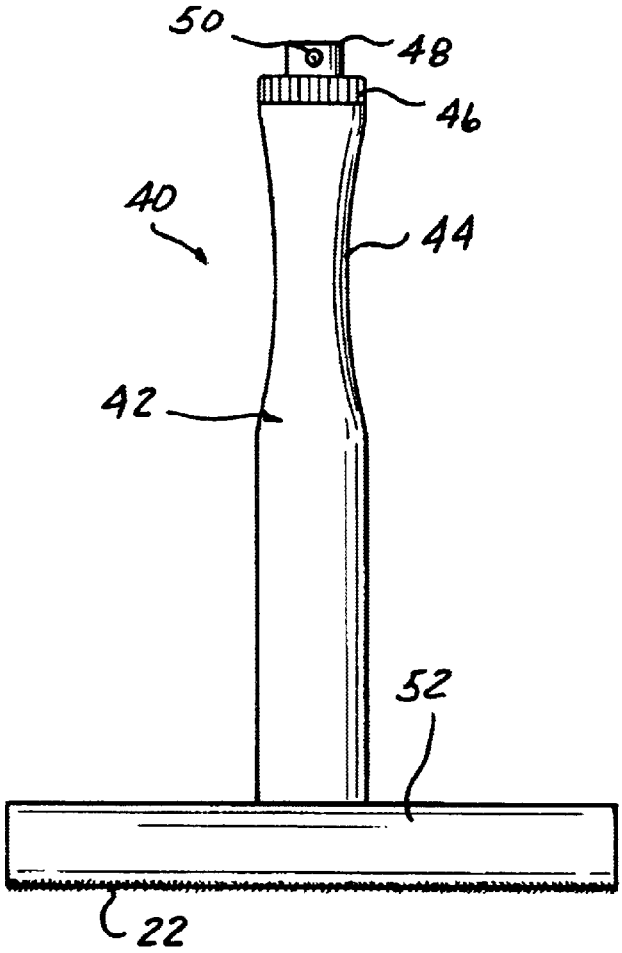
FIG. 7 is a front elevational view of another aspect of the apparatus of the present invention.
Figure 8:
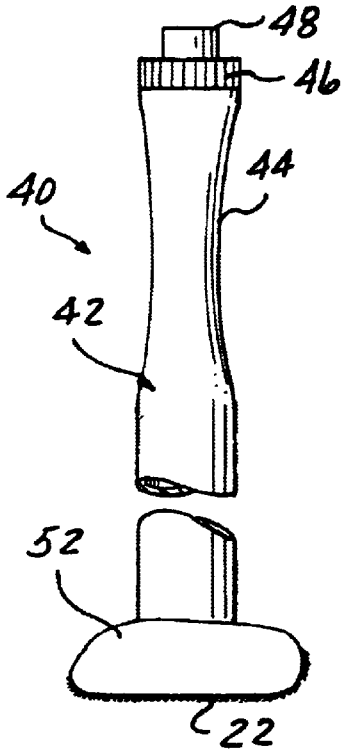
FIG. 8 is a side elevational view of the aspect of the apparatus shown in FIG. 7.

Another aspect of a combination lint remover and spray dispenser apparatus 40 according to the present invention is shown in FIGS. 7 and 8. In this aspect, the apparatus 40 includes a container 42 with a handle portion 44, a cap 46 threadingly or snap-on mounted on one end of the container 42 and carrying a dispenser head 48 and a nozzle 50. The container 42 terminates in an elongated support 52 at one end. The support 52 is typically integrally formed, such as by molding, with the container 42. However, it will be understood that the support 52 may also be separate from the container 42 and joined thereto by adhesive or other fastening means, including threads, etc.

The support 52 has an elongated shape so as to extend outward from one end of the container 42. The support 52 may have any cross sectional shape, with the generally oval shape shown in FIG. 8 which is depicted by way of example only.

In this aspect of the invention, the lint remover is the directional fabric sheet 22 which is mounted, preferably by adhesive, to a portion of the exterior of the support 52. As shown in FIGS. 7 and 8, the directional fabric sheet 22 is mounted at least over the bottom surface of the support 52 in the normal use position of the apparatus 40.

Figure 10:
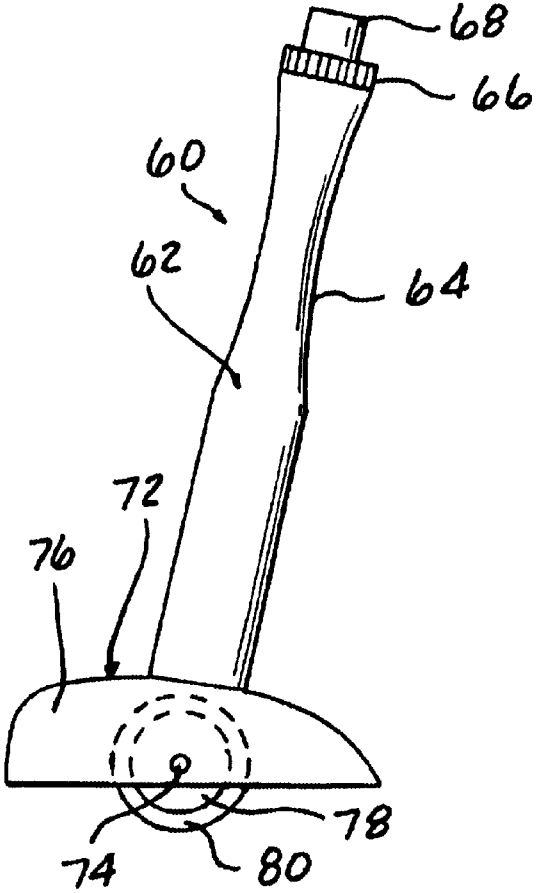
FIG. 10 is a side elevational view of the apparatus shown in FIG. 9.
Figure 9:
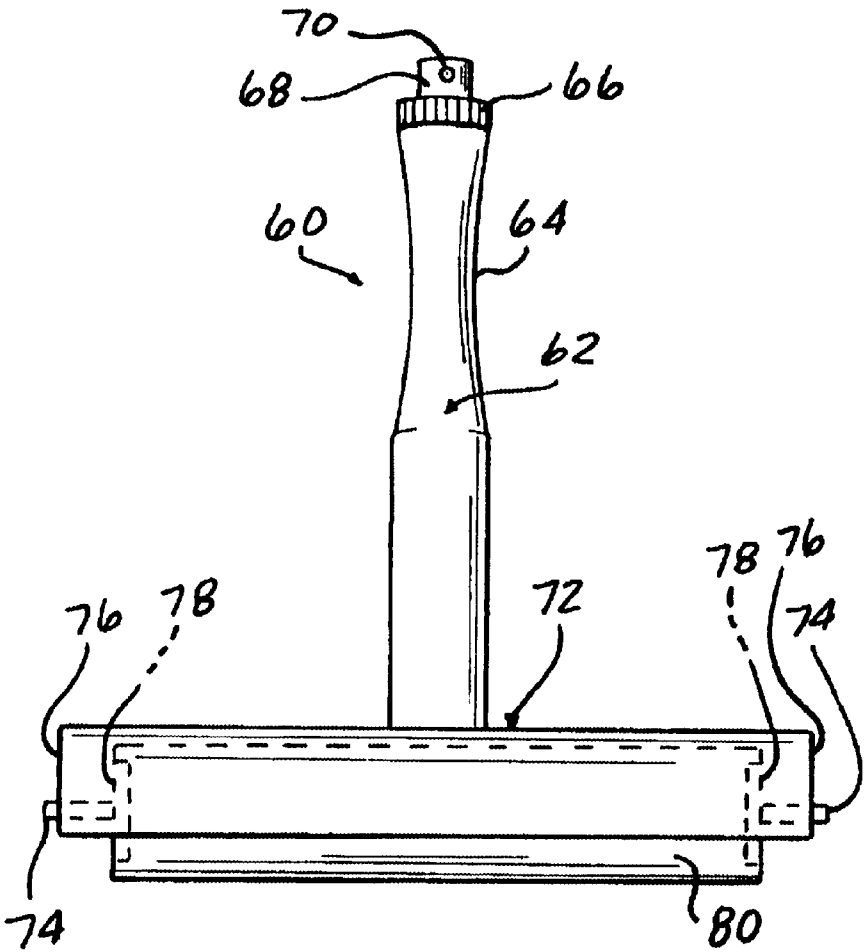
FIG. 9 is a front elevational view of yet another aspect of the apparatus of the present invention.

Referring now to FIGS. 9 and 10, there is depicted another aspect of the present apparatus 60 which also includes a hollow container 62 having a handle portion 64, a cap 66, a dispensing head 68 and a dispenser nozzle 70. In this aspect, a support 72 is mounted by integral molding or by means of separate fasteners, threads, etc., to one end of the container 62. The support 72 is in the form of a cover having a generally semi-circular shape with a hollow interior or internal recess. A pair of hinge pins 74 are mounted in opposed sides 76 of the cover 72 and rotatably support end caps 78 mounted in an elongated tape roll 80. In this manner, the tape roll 80 is rotatably mounted within the support or cover 72.

Figure 11:
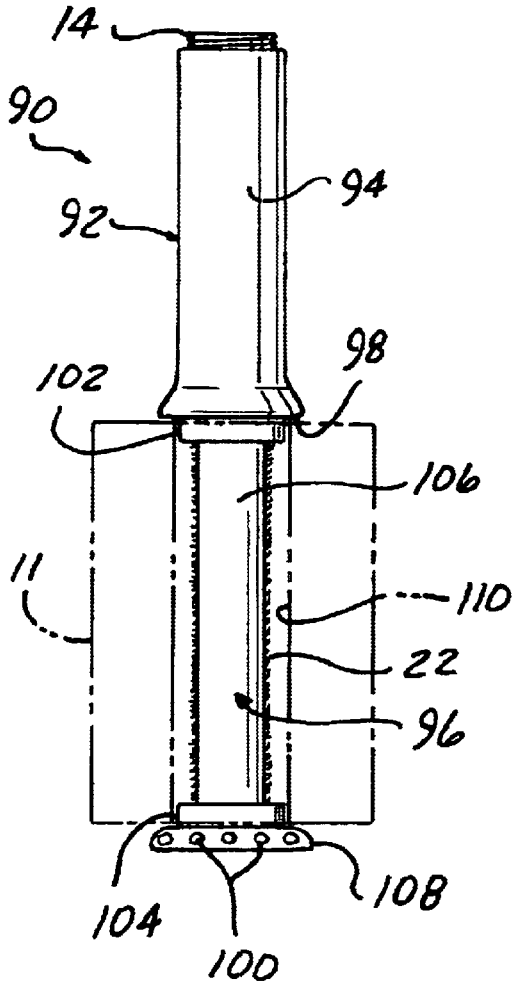
FIG. 11 is a side elevational view showing another aspect of the present apparatus.

In FIG. 11, a lint remover and spray dispenser apparatus 90 is depicted. The apparatus 90 combines the features of the removable and rotatable lint remover roll 11 and hollow container 1 shown in FIGS. 1 and 2 with the directional fabric 22 support shown in FIGS. 3–5. Thus, elements of the apparatus 90 are common with the previous apparatus 1. Specifically, the apparatus 90 includes a hollow container 92 having a handle 94 and a lint remover material support 96. A shoulder 98 is formed intermediate the handle 94 and the support 96. A plurality of outwardly extending projections or nibs 100 are formed on an opposite end of the support 96.

The support 96 is formed with opposed ends 102 and 104 of a first diameter and an intermediate portion 106 of a slightly smaller or reduced diameter. A radially enlarged or flared end 108 is formed at one end of the support section 106 and carries the projections 100. The inner diameter 110 of the lint remover roll 11 is rotatably supported on the larger diameter end portions 102 and 104 of the support section 96 to enable the lint remover roll 11 to rotate about the support section 96. At the same time, the directional fabric 22 is adhesively or otherwise fixedly mounted on the reduced diameter intermediate portion 106 of the support section 96 so as to be located out of contact with the inner diameter 110 of the lint remover roll 11.

A cap 15 with a depressable head 16 and dispenser nozzle 17, as shown in FIG. 1 may be fixedly attached to one end of the handle 94 via the threads 14, by example only.

In this manner, the apparatus 90 is capable of simultaneously carrying the directional lint removal fabric 22 and a rotatable lint remover roll 11. The lint remover roll 11 is removed from the support 96 to enable the directional fabric 22 to be used to remove lint and debris from various surfaces.

Figure 12:
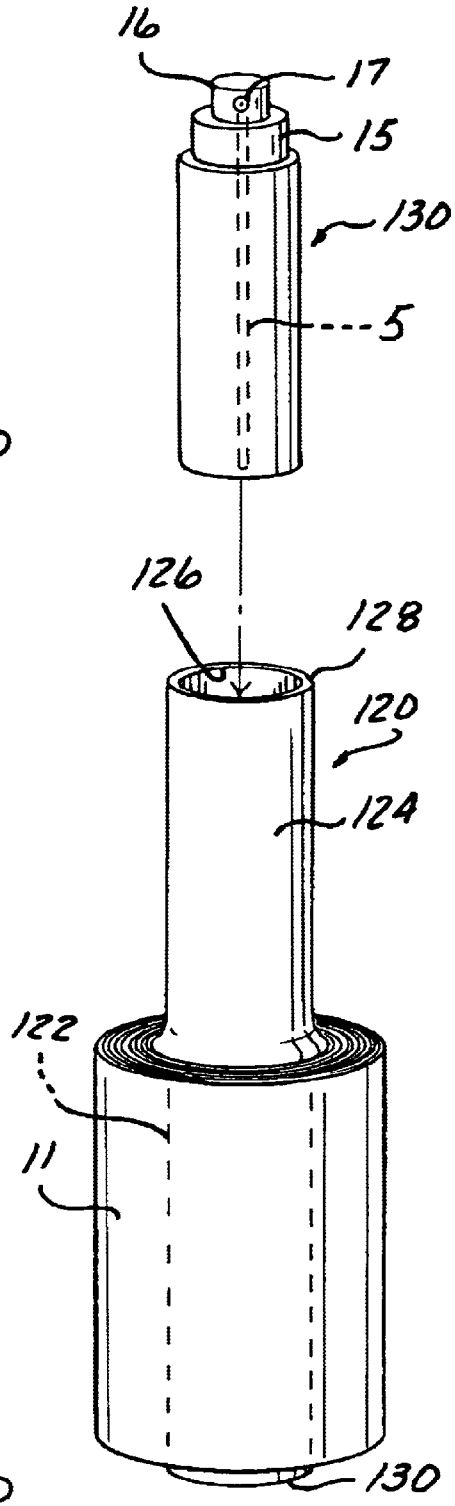
FIG. 12 is an exploded, perspective view of yet another aspect of the present apparatus.

A further modification to any or all of the apparatus describe above is depicted in FIG. 12. It will be understood that although FIG. 12 depicts the apparatus 120 as carrying a lint remover roll 11, the apparatus 120 can also be designed for independent or simultaneous mounting of the directional fabric 22 about a support section 122.

In this aspect of the invention, the handle portion 124 of the apparatus 120 may have an enlarged diameter with an open ended bore 126 extending from one end 128. The opposite end 130 of the apparatus 120 may be opened or closed.

The diameter of the bore 126 is sized to removably receive a liquid dispenser container or bottle 130. The bottle 130 includes, by example only, a removable cap 15 which carries a depressable head 16 and nozzle 17. The inner dispenser tube 5 extends through the interior of the container 130.

The container 130 can be a conventional liquid cleaner supplied with the apparatus 120 or purchased separately therefrom. Regardless of how the container 130 is obtained, the container 130 is removably insertable into the handle 124 through the open ended bore 126 to a distance which disposes the depressable spray dispenser head and nozzle 17 externally of the first end 128 of the handle 124.

A shoulder, not shown, may be provided within the interior of the bore 126 to limit the insertion distance of the container 130 into the bore 126.

In summary, there has been disclosed a unique lint remover and spray dispenser apparatus which combines the lint removal and cleaning features of a removable adhesive lint remover roll or directional fabric with a liquid spray dispenser to provide complete cleaning capabilities of practically any surface in a single device.

What is claimed is:

1. A lint remover and liquid spray apparatus comprising:

a container including a handle;

a liquid storage chamber coupled to the container;

lint removal means;

means, carried on the container in end-to-end arrangement with the handle, for receiving the lint removal means on the container in a use position on the container; and dispenser means, disposed in fluid communication with the liquid storage chamber, for dispensing fluid.

2. The apparatus of claim 1 wherein the lint removal means comprises:

a roll of outwardly facing adhesive tape.

3. The apparatus of claim 1 wherein the lint removal means comprises:

a directional fabric strip.

4. The apparatus of claim 1 wherein the receiving means comprises:

at least a pair of spaced projections carried on the container, the lint removal means mountable between the pair of spaced projections.

5. The apparatus of claim 4 wherein the pair of projections comprises:

an annular shoulder carried on the container; and at least one radially outward projection carried on the container and spaced from the shoulder.

6. The apparatus of claim 5 wherein:

the at least one projection comprises a plurality of circumferentially spaced projections carried on the container.

7. The apparatus of claim 1 further comprising:

a portion of the container separate from receiving means shaped as the handle.

8. The apparatus of claim 1 wherein the receiving means comprises:

means carried on the container for mounting the lint removal means about the container.

9. The apparatus of claim 1 wherein the receiving means comprises:

a lint removal means support carried at one end of the container.

10. The apparatus of claim 9 wherein the lint removal receiving means comprises:

means carried on the lint removal means and the receiving means for rotatably mounting the lint removal means on the receiving means.

11. The apparatus of claim 1 wherein the container further comprises:

a second portion contiguous with the handle for receiving the lint removal means, the second portion disposed at an angle with respect to the handle.

12. The apparatus of claim 1 wherein:

the liquid storage chamber is formed internally within the container.

13. The apparatus of claim 12 wherein:

the dispenser means is mounted on the container.

14. The apparatus of claim 1 wherein:

at least the handle has a closed outer surface.

15. The apparatus of claim 1 wherein:

the handle and the lint removal means are co-axial.

16. The apparatus of claim 1 further comprising:

means, coupled to the container, for rotatable supporting a lint roll with respect to the container.

17. The apparatus of claim 1 wherein:

the dispenser means is coupled to the container adjacent to one end of the lint removal means.

18. The apparatus of claim 1 wherein:

the dispenser means is mounted on the handle.

19. A lint removal and liquid spray apparatus comprising:

a container, the container including an open ended bore extending from one end;

a liquid storage chamber carried in a separate body mountable in the bore in the container;

lint removal means;

means, carried on the container, for receiving the lint removal means on the container; and dispenser means, disposed in fluid communication with the liquid storage chamber, for dispensing fluid.

20. A lint remover and liquid spray apparatus comprising:

a container;

a liquid storage chamber coupled to the container;

lint removal means including a roll of outwardly facing adhesive tape and at least one directional fabric strip;

means, carried on the container, for receiving the lint removal means on the container, the receiving means including a first means for rotatably mounting the roll of outwardly facing adhesive tape on the container and a second means for fixedly mounting the directional fabric strip on the container and non-contactingly spaced from the roll of adhesive tape; and dispenser means, disposed in fluid communication with the liquid storage chamber for dispensing fluid.

* * * * *